US010767122B2

(12) United States Patent
Oprins et al.

(10) Patent No.: US 10,767,122 B2
(45) Date of Patent: Sep. 8, 2020

(54) METHOD FOR PRODUCING HIGH-QUALITY FEEDSTOCK FOR A STEAM CRACKING PROCESS

(71) Applicant: SABIC GLOBAL TECHNOLOGIES B.V., Bergen op Zoom (NL)

(72) Inventors: Arno Johannes Maria Oprins, Geleen (NL); Raul Velasco Pelaez, Geleen (NL); Egidius Jacoba Maria Schaerlaeckens, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 15/778,456

(22) PCT Filed: Nov. 21, 2016

(86) PCT No.: PCT/EP2016/078300
§ 371 (c)(1),
(2) Date: Oct. 30, 2018

(87) PCT Pub. No.: WO2017/093059
PCT Pub. Date: Jun. 8, 2017

(65) Prior Publication Data

US 2019/0055480 A1 Feb. 21, 2019

(30) Foreign Application Priority Data

Nov. 30, 2015 (EP) ..... 15196944

(51) Int. Cl.
*C10G 55/00* (2006.01)
*C10G 55/04* (2006.01)
*C10G 53/06* (2006.01)

(52) U.S. Cl.
CPC ..... *C10G 55/04* (2013.01); *C10G 53/06* (2013.01); *C10G 2300/1085* (2013.01);
(Continued)

(58) Field of Classification Search
CPC ..... C10G 53/02; C10G 53/04; C10G 53/06; C10G 55/02; C10G 55/04; C10G 2300/44;
(Continued)

(56) References Cited

U.S. PATENT DOCUMENTS 5,107,056 A 4/1992 Chen et al.
5,215,649 A 6/1993 Grenoble et al.
(Continued)

FOREIGN PATENT DOCUMENTS

CN 103864554 6/2014
EP 0697455 2/1996
(Continued)

OTHER PUBLICATIONS

ExxonMobil, EXOL N™ Solvent Extraction Technology, Accessed from the Internet on Feb. 24, 2017, URL: www.exxonmobil.com/refiningtechnologies.
(Continued)

*Primary Examiner* — Prem C Singh
*Assistant Examiner* — Brandi M Doyle
(74) *Attorney, Agent, or Firm* — Norton Rose Fulbright US LLP

(57) ABSTRACT

The present invention relates to a method for producing high-quality feedstock for a steam cracking process, said method comprising the following steps: i) providing a hydrocarbon feedstock; ii) contacting said hydrocarbon feedstock with a solvent at a dosage effective to remove aromatics and naphthenes from said feedstock forming a refined feedstock and one or more aromatics and naphthenes containing streams; iii) processing said refined feedstock in a steam cracking process.

5 Claims, 2 Drawing Sheets

(52) U.S. Cl.
CPC ..... *C10G 2300/1096* (2013.01); *C10G 2300/301* (2013.01); *C10G 2300/44* (2013.01)

(58) Field of Classification Search
CPC ..... C10G 2300/1096; C10G 2300/301; C10G 2300/1085
See application file for complete search history.

(56) References Cited

U.S. PATENT DOCUMENTS

| | | | |
|---|---|---|---|
| 6,153,087 | A | 11/2000 | Bigeard et al. |
| 6,270,654 | B1 | 8/2001 | Colyar et al. |
| 7,214,308 | B2 | 5/2007 | Colyar |
| 7,704,377 | B2 | 4/2010 | Duddy et al. |
| 7,938,952 | B2 | 5/2011 | Colyar et al. |
| 8,926,824 | B2 | 1/2015 | Morel |
| 9,005,430 | B2 | 4/2015 | Fournier et al. |
| 9,840,674 | B2 | 12/2017 | Weiss et al. |
| 2008/0093262 | A1 | 4/2008 | Gragnani et al. |
| 2014/0299515 | A1 | 10/2014 | Weiss et al. |
| 2016/0122666 | A1 | 5/2016 | Weiss et al. |

FOREIGN PATENT DOCUMENTS

| | | |
|---|---|---|
| GB | 1248814 | 10/1971 |
| GB | 2040306 | 8/1980 |
| WO | WO 2016/146326 | 9/1916 |
| WO | WO 2015/000843 | 1/2015 |
| WO | WO 2015/000846 | 1/2015 |

OTHER PUBLICATIONS

International Search Report and Written Opinion issued in International Patent Application No. PCT/EP2016/078300, dated Feb. 1, 2017.

Nouri et al., "Evaluation of solvent dearomatization effect in heavy feedstock thermal cracking to light olefin: An optimization study," *Korean Journal of Chemical engineering*, 30(9):1700-1709, (2013).

Folkins, "Benzene," *Ullmann's Encyclopedia of Industrial Chemistry*, 2000, 5:237-268.

METHOD FOR PRODUCING HIGH-QUALITY FEEDSTOCK FOR A STEAM CRACKING PROCESS

CROSS REFERENCE TO RELATED APPLICATIONS

This application is a national phase under 35 U.S.C. § 371 of International Application No. PCT/EP2016/078300, filed Nov. 21, 2016, which claims the benefit of priority to European Patent Application Serial No. 15196944.1, filed Nov. 30, 2015. The entire contents of each of the above-referenced applications are hereby incorporated into the present application by reference in their entirety.

The present invention relates to a method for producing high-quality feedstock for a steam cracking process.

ExxonMobil's extraction process EXOL relates to a process for removing the undesirable aromatics and polar components of a lube feed stock from the desirable paraffinic and naphthenic components. The oil feed, either vacuum distillates or deasphalted oils, enters the bottom of the treater while the NMP (n-methyl-2-pyrrolidone) solvent, containing a carefully controlled amount of water, enters the top of the treater and counter currently contacts the rising raffinate solution. The oil-rich phase leaving the top of the treater contains the raffinate product saturated with solvent. The heavier extract solution phase exits the bottom of the treater carrying the extracted aromatics and polar components. The solvent is recovered through either gas or steam stripping.

In an article of Mohsen Nouri in Korean J. Chem. Eng., 30(9), 1700-1709 (2013), "Evaluation of solvent dearomatization effect in heavy feedstock thermal cracking to light olefin: An optimization study" the effect of aromatic extraction of heavy feedstock in thermal cracking was studied. N-methylpyrrolidone as the solvent performing dearomatization of feedstock was at different temperature and molar solvent to oil ratios. Yields of ethylene and propylene increased by more than 10%, while the liquid products with five or more carbon atoms decreased by 13% on average on dearomatization. This is assigned to higher content of naphthenes in raffinate, which is easier to crack to produce light olefin. Further content of aromatics in the untreated feed leads to forming heavy liquid products and higher coke formation.

EP 0 697 455 relates to a process for the preparation of a hydrowax from hydrocarbon oil fractions heavier than flashed distillates, which hydrowax can be suitably applied as a feedstock in steam cracking processes for producing lower olefins, particularly ethylene. More in detail, the process according to EP 0 697 455 for producing a hydrowax comprises the steps of hydrocracking a blend obtained by blending at least one distillate fraction and a deasphalted oil (DAO), separating from the hydrocracker effluent a fraction of which at least 90% by weight has a boiling point of 370° C. or higher (the 370+ fraction), and separating the 370+ fraction in a top-fraction and a bottom-fraction at an effective cutpoint below 600° C., thus yielding the hydrowax as the top-fraction.

U.S. Pat. No. 5,107,056 relates to a method for separating naphthenes from aliphatic hydrocarbon-rich feed streams containing mixtures of naphthenes with paraffins comprising the steps of contacting the aliphatic hydrocarbon-rich feed stream with one side of a nonselective, porous partition barrier membrane while simultaneously contacting the other side of the partition barrier membrane with a polar solvent, in the absence of a pressure differential across the membrane, to thereby selectively permeate the naphthenic hydrocarbon through the porous partition barrier in response to the polar solvent present on the permeate side of said membrane.

WO2015000846 in the name of the present applicant relates to a method of producing aromatics and light olefins from a hydrocarbon feedstock comprising the steps of subjecting the hydrocarbon feedstock to a solvent extraction process in a solvent extraction unit; separating from the solvent extracted hydrocarbon feedstock obtained a raffinate fraction comprising paraffins and a fraction comprising aromatics and naphthenes; converting said fraction comprising aromatics and naphthenes in a hydrocracking unit and separating into a high content aromatics fraction and a stream high in light paraffins; converting said raffinate fraction in a steam cracking unit into light olefins.

WO2015000843 in the name of the present applicant relates to a process for increasing the production of a light olefin hydrocarbon compound from a hydrocarbon feedstock, comprising the following steps of feeding a hydrocarbon feedstock into a reaction area for ringopening operating at a temperature range of 300-500° C. and a pressure range of 2-10 MpPa, separating reaction products, which are generated from said reaction area, into an overhead stream and a side stream; feeding the side stream to a gasoline hydrocracker (GHC) unit operating at a temperature range of 300-580° C. and a pressure range of 0.3-5 MPa, wherein said gasoline hydrocracker (GHC) unit is operated at a temperature higher than said ring opening reaction area, and wherein said gasoline hydrocracker (GHC) unit is operated at a pressure lower than said ring opening reaction area, separating reaction products of the GHC into an overhead gas stream, comprising $C_2$-$C_4$ paraffins, hydrogen and methane and a stream comprising aromatic hydrocarbon compounds and non-aromatic hydrocarbon compounds, and feeding the overhead gas stream from the gasoline hydrocracker (GHC) unit into a steam cracker unit.

GB 2 040 306 relates to a process for the extraction of aromatic constituents from gas-oil, comprising introducing to a liquid-liquid contactor a stream of gas-oil and contacting the stream with a substantially immiscible stream comprising a selective solvent for the aromatic constituents of the gas-oil and withdrawing from the contactor a liquid stream comprising solvent and aromatic constituents extracted from the gas-oil, and a liquid stream comprising the gas-oil freed from at least a portion of its aromatic constituents. The solvent is selective also for the organic sulphur constituents of the gas-oil and the liquid stream comprising the gas-oil freed from at least a portion of its aromatic constituents is also freed from at least a portion of the organic sulphur constituents.

GB 1 248 814 relates to a process for obtaining improved production of olefins for aromatic-containing hydrocarbon feeds boiling in the gas oil range, which comprises treating the feed to selectively remove aromatic compounds and feeding the treated feed, i.e. raffinate, to a hydrocarbon cracking zone. This British document teaches that the removal, i.e. separation, of aromatics from petroleum distillates boiling in the gas oil range while retaining paraffinic and naphthenic compounds in said distillates, can be accomplished by solvent extraction.

Thermal steam cracking is a known method for producing lower olefins, particularly ethene and propene. It is a strongly endothermic process and basically involves heating a hydrocarbon oil feed to a sufficiently high temperature for cracking reactions to occur followed by rapid cooling of the reactor effluent and fractionation of this effluent into the different products. A steam cracker, also commonly referred to as an ethene cracker, usually consists of a hot section and a cold section. The hot section consists of cracking furnaces, a cooling section and a primary fractionator for separating the effluent. Steam is introduced into the cracking furnace to dilute the feed. This is favorable for the final olefin yield, while the added steam also suppresses the deposition of coke in said furnace. In the cold section the cracked gas is further separated into the various end products among which are pure ethene and propene.

The direct using of heavy fractions in a thermal steam cracking process as either main raw feedstock or an alternative feed (by its own or co-fed) is limited in the downstream equipment and recovery units. Heavier liquid feeds produce lower ethylene and propylene, though less desirable byproduct yield, such as fuel oil increase through cracking these feeds. Employing a pretreatment process before the steam cracking is indispensable to improving heavy fractions quality, wherein several treatments such as extracting aromatic, visbreaking, hydrotreating, hydrocracking, two-stage cracking can upgrade heavy fractions.

The present invention is directed to a pre-treatment of a feed before further processing the feed to a steam cracking operation.

The present invention thus relates to a method for producing high-quality feedstock for a steam cracking process, said method comprising the following steps:

i) providing an aromatics and naphthenes containing hydrocarbon feedstock;

ii) contacting said hydrocarbon feedstock with a solvent at a dosage effective to remove aromatics and naphthenes from said feedstock forming a refined feedstock and one or more aromatics and naphthenes containing streams;

iii) processing said refined feedstock in a steam cracking process.

According to such a method a solvent extraction process produces a paraffin-rich stream, which provides enhanced olefin yields in a steam cracker unit compared to a process in which untreated hydrocarbon feedstock is used. In a preferred embodiment the refined feedstock, i.e. the raffinate or the feed to be processed in the steam cracking process, has a specific composition, namely the aromatics content is in the range of 0-5% wt and the naphthenes content is in the range of 0-25% wt, based on the total weight of the feed. The composition of the extract, i.e. the aromatics and naphthenes containing streams, would depend on the composition of the feedstock fed to the solvent extraction unit in step ii) but basically the part of the feedstock that it's not recovered as raffinate it is recovered as extract.

The present inventors assume that according to an embodiment of the present invention the raffinate is completely depleted in aromatics but some monoaromatics molecules with long paraffinic branches might not be extracted and therefore resulting in an upper value in the range of aromatic content (5% wt). The monoaromatics content in VGO is usually below 10% so an extraction efficiency of at least 50% is a fair assumption. The naphthenic levels stated above are based in a correlation between Viscosity Index and composition obtained by NMR spectroscopy for a series of base oils (most of them hydrotreated to a certain extent). Within the range of solvent extraction conditions (solvent/oil ratio and extraction temperatures) as will be described later in the present description, a range of 15-25% wt of naphthenes in the raffinate could be expected. The lower range of 0% as mentioned before refers to an embodiment for covering very paraffinic feedstocks that might have not been covered in the correlation with hydrotreated samples (those would be more naphthenic in nature that untreated VGOs which are a part of the present invention).

In an embodiment wherein the aromatic/naphthenic level is higher than mentioned above is that the extent of the benefit in liquid steam cracking yields would be less, so less ethylene+propylene and more pyoil would be produced. The extent of the effect for different raffinate compositions/steam cracker feedstocks has been shown in the examples described later in the present description.

In a preferred embodiment step ii) comprises two sub steps, namely a step iia) comprising separation of aromatics from said hydrocarbon feedstock of step i) thereby forming a naphthenes containing intermediate stream and an aromatics containing stream and a step lib) comprising separation of naphthenes from said intermediate stream thereby forming a naphthenes containing stream and said refined feedstock.

According to such an embodiment the refined feedstock, i.e. the raffinate or the feed to be processed in the steam cracking process, has a specific composition, namely the aromatics content is in the range of 0-2% wt and the naphthenes content is in the range of 0-10% wt. The naphthenes containing stream has a specific composition, namely the aromatics content is in the range of 0-10% wt the naphthenes content is in the range of 50-100% wt, and the paraffins content is in the range of 0-40% wt. The aromatics containing stream has a specific composition, namely the aromatics content is in the range of 60-100% wt, the naphthenes content is in the range of 0-40% wt, and the paraffins content is in the range of 0-20 wt %. The composition of the naphthenes containing intermediate stream has an aromatics content in the range of 0-25% wt, a naphthenes content in the range of 10-50% wt, and a paraffins content in the range of 40-100% wt. All percentages are based on the total weight of the relevant stream concerned.

According to another preferred embodiment step ii) comprises simultaneously removal of aromatics and naphthenes from said feedstock forming a refined feedstock.

The preferred hydrocarbon feedstock has a boiling range in a range of 300-550° C. Preferably, the feedstock is rich in paraffins to maximize the yield to steam cracker. An example of such a preferred feedstock is a hydrocarbon feedstock originating from a paraffinic crude oil.

In case of using a hydrocarbon feedstock originating from a paraffinic crude oil step ii) is preferably carried out at within a temperature range of 85 to 125° C. and a solvent dosage within the range of 250 to 450 percent. And step iia) preferably comprises a temperature range of 50 to 125° C., more preferably within a range of 60 to 85° C. and a solvent dosage within a range of 50 to 450 percent, preferably 100 to 340 percent. Prior to the introduction to the steam cracker, an additional solvent recovery unit could be used to minimize the amount of solvent entering the furnaces and minimize the solvent losses.

An example of such a preferred feedstock is a hydrocarbon feedstock originating from a naphthenic crude oil, especially a hydrocarbon feedstock having a boiling range in a range of 300-550° C. More preferably, a paraffinic feedstock because that will give the highest yields in ethylene per ton feed.

In case of using a hydrocarbon feedstock originating from a naphthenic crude oil step ii) is preferably carried out at within a temperature range of 65 to 95° C. and a solvent dosage within the range of 150 to 300 percent. And step iia) preferably comprises a temperature range of 10 to 95° C., more preferably 20 to 65° C., and a solvent dosage within a range of 50 to 300 percent, preferably 75 to 200 percent.

In a preferred embodiment present step iib) comprises a membrane extraction process. In such a membrane extraction process the feed stream is passed along one side of a porous, non-selective partition barrier membrane, for example an ultrafiltration membrane, made of ceramic, sintered glass or metal, or of a polymeric material such as polyethylene, polypropylene, Teflon, cellulose, nylon, etc. Its pore size is preferably in the range 100 to 5000 Angstrom.

According to another embodiment of the present method for producing high-quality feedstock for a steam cracking process step iii) further comprises applying a step of removing traces of solvent from said refined feedstock before processing said refined feedstock in a steam cracking process.

The present method further comprises recovering solvent from said one or more aromatics and naphthenes containing streams forming a recovered solvent stream and one or more streams rich in aromatics and naphthenes, wherein said one or more streams rich in aromatics and naphthenes are further processed in refinery process units, such as hydrocracking processes, carbon black production processes, or direct blending into fuels. Another preferred use of said one or more streams rich in aromatics and naphthenes is as a quench oil material in liquid steam crackers.

The solvent used in the present method for producing high-quality feedstock for a steam cracking process is preferably chosen from the group of n-methyl-2-pyrrolidone, furfural and phenol and mixtures thereof, including the presence of cosolvents, such as water.

The present invention will now be illustrated by way of examples and figures.

Figure 1:
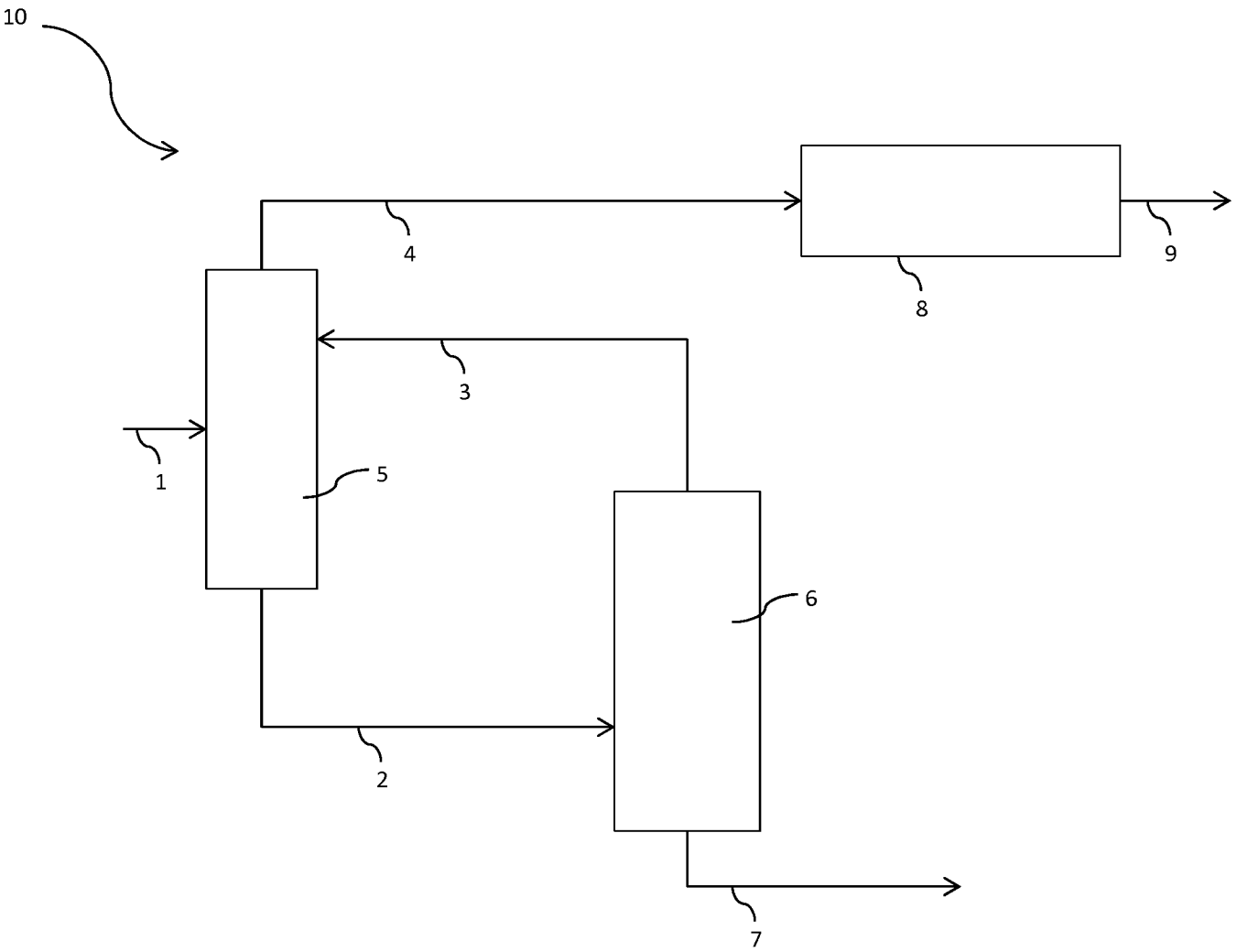
FIG. 1 shows an embodiment of the present method for producing high-quality feedstock for a steam cracking process.

FIG. 1 shows a process 10 for producing high-quality feedstock for a steam cracking process. A hydrocarbon feedstock 1 is passed into a solvent extraction unit 5, where it is separated into a bottom stream 2 and a top stream 4. Bottom stream 2 comprises aromatics, naphthenes and solvent, top stream 4 comprises paraffins. Bottom stream 2 is passed into solvent recovery unit 6, where it is separated into a stream 7 rich in aromatics and naphthenes. The solvent 3 thus recovered is recycled to solvent extraction unit 5. Top stream 4 is passed into steam cracking unit 8 for producing a stream 9 comprising olefins and BTX (benzene, toluene and xylenes). FIG. 1 relates to the one-step process, i.e. the simultaneously removal of aromatics and naphthenes from feed 1. In an embodiment the aromatics content of stream 4 (raffinate) is in the range of 0-5% wt and naphthenes in the range of 0-25% wt. The composition of stream 7 (extract) would depend on the composition of the feedstock fed to the solvent extraction unit but basically the part of the feedstock that it's not recovered as raffinate it is recovered as extract.

Figure 2:
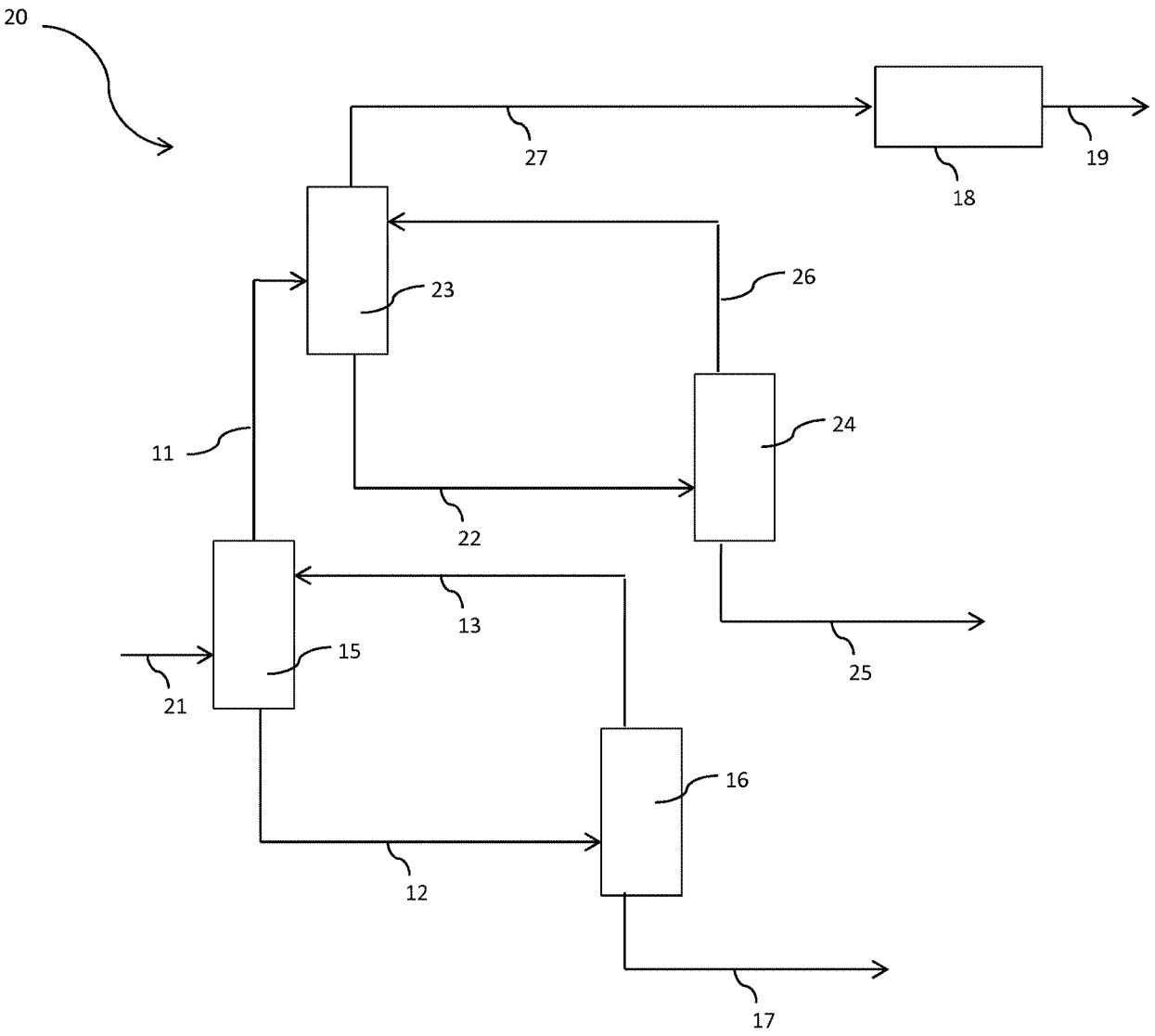
FIG. 2 shows another embodiment of the present method for producing high-quality feedstock for a steam cracking process.

FIG. 2 shows a process 20 for producing high-quality feedstock for a steam cracking process. A hydrocarbon feedstock 21 is passed into a first solvent extraction unit 15, where it is separated into a bottom stream 12 and a top stream 11. Bottom stream 12 comprises aromatics and solvent, top stream 11 comprises naphthenes and paraffins. Bottom stream 12 is passed into first solvent recovery unit 16, where it is separated into a stream 17 rich in aromatics. The solvent 13 thus recovered is recycled to first solvent extraction unit 15. Top stream 11 is passed into a second solvent extraction unit 23 where it is separated into a bottom stream 22 and a top stream 27. Bottom stream 22 comprises naphthenes and solvent, top stream 27 comprises paraffins. Bottom stream 22 is passed into second solvent recovery unit 24, where it is separated into a stream 25 rich in naphthenes. The solvent 26 thus recovered is recycled to second solvent extraction unit 23. Top stream 27 is passed into steam cracking unit 18 for producing a stream 19 comprising olefins and BTX (benzene, toluene and xylenes). The naphthenic compounds containing stream 25 can be sent to several process units, such as steam cracker furnaces, steam cracker quench system and sold as naphthenic lube stock. In an embodiment the aromatics content of stream 27 (steam cracker feedstock) is in the range of 0-2% wt and naphthenes in the range of 0-10% wt. For stream 25 (naphthenic-rich stream) the aromatics content is in the range of 0-10% wt, naphthenes in the range of 50-100% wt, paraffins in the range of 0-40% wt. For stream 17 (aromatic-rich stream) the aromatics content is in the range of 60-100% wt, naphthenes in the range of 0-40% wt, paraffins in the range of 0-20%. For stream 11 (feed to second solvent-extraction process) the aromatics content is in the range of 0-25% wt, naphthenes in the range of 10-50% wt, paraffins in the range of 40-100%.

FIG. 2 relates to the two-step process, i.e. a step comprising separation of aromatics from the hydrocarbon feedstock thereby forming an intermediate stream and a step comprising separation of naphthenes from the intermediate stream. The inventors assume that the purity of the paraffinic stream originated in FIG. 2 is higher than the one created in FIG. 1.

In addition, the embodiment shown in FIG. 2 comprises two separate solvent recovery units, namely first solvent recovery unit 16 and second solvent recovery unit 24. However, in a preferred embodiment (not shown) these solvent recovery units could be combined into a single unit.

In addition the processing scheme according to FIG. 2 allows for the independent production of paraffins and naphthenes. Cracking conditions in steam cracker furnaces could be tuned for optimal yields for each stream. This is not possible when sending paraffins together with naphthenes to the furnaces.

The present inventors found that in the process as shown in FIG. 1 the lighter the molecules, i.e. the composition of top stream 4, the better the steam cracker yields will be. In the process as shown in FIG. 2, naphthenes could be used as quenching material that would act as hydrogen donor and minimize the condensation reactions happening in this part of the steam cracking process. Moreover, since the temperature of this stream will be in the order of 150-200° C., it can constitute a comparable or even better quenching material than the typically used aromatic-rich streams.

Thus, the apparatus used in the present method can comprise a single extraction zone or multiple extraction zones equipped with shed rows or other stationary devices to encourage contacting, orifice mixers, or efficient stirring devices, such as mechanical agitators, jets of restricted internal diameter, turbo mixers and the like. The operation may be conducted as a batch wise or as a continuous-type operation with the latter operation being preferred. A particularly preferred operational configuration comprises continuous countercurrent extraction. It is important to note that the equipment employed in the operation of the extraction process is not critical to the overall efficiency of the extraction and can comprise rotating disc contactors, centrifugal contactors, countercurrent packed bed extraction columns, countercurrent tray contactors and the like.

EXAMPLES

Following the processing scheme shown in FIG. 1 different types of steam cracker feedstocks have been produced starting from vacuum gasoil (VGO) depending on the degree of separation in the solvent extraction process. Starting from Arab Light VGO (properties shown in Table 1) six different feedstocks could be generated:

VGO1: Full VGO

VGO2: Dearomatized VGO (not containing aromatics)

VGO3: Paraffinic VGO (not containing aromatics or naphthenes)

VGO4: Feed containing all paraffins and 20% of naphthenes present in VGO

VGO5: Feed containing all paraffins and all mono-ring naphthenes present in VGO

VGO6: Feed containing all paraffins and 20% of lighter naphthenes present in VGO

TABLE 1

Arab Light VGO composition

| | % wt. |
|---|---|
| Paraffins | 31.4 |
| Total Naphthenes | 12.6 |
| Mononaphthenes | 9.8 |
| Aromatics | 56.0 |

Apart from full VGO (identified as VGO1) and solvent-extracted VGOs (identified as VGO2-VGO6), two unconverted oil streams (UCO1 and UCO2) were also provided as feedstocks for comparative examples.

Table 2 shows that the main difference between these two streams lies on their different hydrogen content (UCO1=14.3% wt. and UCO2=13.7% wt). Hydrotreatment/hydrocracking is the conventional way to enable the processing of vacuum distillates in a steam cracker.

TABLE 2

Unconverted oil properties

| Property | | UCO1 | UCO2 |
|---|---|---|---|
| H-content | wt. % | 14.3 | 13.7 |
| Specific gravity | kg/kg | 0.83 | 0.84 |
| IBP | ° C. | 342 | 342 |
| 10% | ° C. | 367 | 367 |
| 30% | ° C. | 402 | 402 |
| 50% | ° C. | 429 | 429 |
| 70% | ° C. | 461 | 461 |
| 90% | ° C. | 516 | 516 |
| FBP | ° C. | 579 | 579 |

Once-through steam cracker yields (in % wt. for all different feeds) are presented in Table 3. These yields have been estimated using Spyro software using the following characteristics: feed rate=30 ton/h, Coil Outlet Temperature (COT)=775° C. Steam/Oil ratio=0.75 w/w, Coil Outlet Pressure (COP)=1.7 bara.

TABLE 3

Once-through steam cracker yields in % wt.

| | VGO1 | VGO2 | VGO3 | VGO4 | VGO5 | VGO6 | UCO1 | UCO2 |
|---|---|---|---|---|---|---|---|---|
| $H_2$ | 0.3 | 0.4 | 0.4 | 0.4 | 0.4 | 0.4 | 0.4 | 0.3 |
| $CH_4$ | 5.8 | 7.3 | 7.0 | 7.1 | 7.3 | 7.0 | 7.0 | 7.1 |
| Ethylene | 17.8 | 26.7 | 29.2 | 28.6 | 27.3 | 28.6 | 26.3 | 24.6 |
| Ethane | 2.3 | 4.0 | 4.3 | 4.2 | 4.1 | 4.3 | 3.9 | 3.6 |
| Propylene | 12.6 | 18.7 | 19.5 | 19.3 | 19.1 | 19.3 | 17.7 | 16.9 |
| Butadiene | 4.2 | 7.1 | 7.3 | 7.2 | 7.2 | 7.2 | 6.8 | 6.2 |
| Isobutene | 1.8 | 2.4 | 2.1 | 2.2 | 2.4 | 2.2 | 1.9 | 1.9 |
| Benzene | 1.9 | 3.3 | 2.6 | 2.8 | 3.3 | 2.8 | 3.1 | 2.5 |
| Toluene | 1.1 | 1.7 | 1.1 | 1.3 | 1.5 | 1.3 | 1.9 | 1.3 |
| Xylene | 0.6 | 0.5 | 0.3 | 0.3 | 0.4 | 0.4 | 0.9 | 0.5 |
| C9+ | 37.7 | 4.6 | 2.9 | 3.3 | 3.2 | 3.3 | 9.0 | 16.0 |
| Propylene + Ethylene | 30.4 | 45.4 | 48.7 | 47.9 | 46.4 | 47.9 | 44.0 | 41.5 |

In the above examples VGO2 is a completely aromatic-depleted raffinate but with all naphthenes, VGO3 is a completely aromatic and naphthenic-depleted raffinate and VGO4-6 show the effect of still having some naphthenes in the feed to the steam cracker: VGO4=8% wt naphthenes; VGO5=17% wt naphthenes; VGO6=3% wt naphthenes). The present inventors found that the raffinate composition is partially determined by the efficiency of the solvent extraction process and the economic trade-offs: higher temperatures and higher solvent/oil ratios will lower the aromatics and naphthenes content but the higher the energy consumption. These ranges of aromatic and naphthenic content are different than those shown by the discussed prior art references, i.e. Nouri et al. (Arom=19% and Naph=28%) and GB 1 248 814 ("raffinate contains all paraffins & cycloparaffins of the gas oil" and "extract contains 71% of the aromatics contained in the gas oil" so a considerable amount of aromatics are still in raffinate).

From Table 3, it can be seen that dearomatization of VGO (VGO2) enhances the propylene and ethylene yields by 50% compared to processing full VGO (VGO1) while reducing the production of C9-plus components by 88%. Subsequent removal of all naphthenes (VGO3) provides a further increase of propylene and ethylene yields to 48.7% (3.3% more than VGO2) reducing even more the C9-plus production.

All solvent-extracted VGOs show better ethylene and propylene yields than unconverted oils with the advantage of not requiring hydrogen or capital-intensive hydroprocessing units.

The invention claimed is:

1. A method for producing high-quality feedstock for a steam cracking process, said method comprising the steps of:

i.) providing an aromatics and naphthenes containing hydrocarbon feedstock;

ii.) contacting said hydrocarbon feedstock with furfural at a dosage effective to remove aromatics and naphthenes from said feedstock forming a refined feedstock and one or more aromatics and naphthenes containing streams;

iii.) processing said refined feedstock in a steam cracking process;

wherein step ii) comprises two sub steps, namely a step iia) comprising separation of aromatics from said hydrocarbon feedstock of step i) thereby forming a naphthenes containing intermediate stream and an aromatics containing stream, and a step iib) comprising separation of naphthenes from said intermediate stream thereby forming a naphthenes containing stream and said refined feedstock;

wherein said hydrocarbon feedstock originates from a naphthenic crude oil;

wherein step iia) comprises a temperature range of 50 to 125° C. and a solvent dosage within a range of 50 to 450 percent;

wherein said hydrocarbon feedstock has a boiling range in a range of 300-550° C.;

and wherein the refined feedstock consists of paraffinic vacuum gas oil that does not contain aromatics or naphthenes.

2. The method according to claim 1, wherein step iii) further comprises applying a step of removing traces of solvent from said refined feedstock before processing said refined feedstock in a steam cracking process.

3. The method according to claim 1, further comprising recovering solvent from said one or more aromatics and naphthenes containing streams forming a recovered solvent stream and one or more streams rich in aromatics and naphthenes.

4. The method according to claim 3, wherein said one or more streams rich in aromatics and naphthenes are further processed in refinery process units.

5. A method for producing high-quality feedstock for a steam cracking process, said method consisting of the steps of:

i.) providing an aromatics and naphthenes containing hydrocarbon feedstock;

ii.) contacting said hydrocarbon feedstock with furfural at a dosage effective to remove aromatics and naphthenes from said feedstock forming a refined feedstock and one or more aromatics and naphthenes containing streams;

iii.) processing said refined feedstock in a steam cracking process;

wherein step ii) comprises two sub steps, namely a step iia) comprising separation of aromatics from said hydrocarbon feedstock of step i) thereby forming a naphthenes containing intermediate stream and an aromatics containing stream, and a step iib) comprising separation of naphthenes from said intermediate stream thereby forming a naphthenes containing stream and said refined feedstock;

wherein said hydrocarbon feedstock originates from a naphthenic crude oil;

wherein step iia) comprises a temperature range of 50 to 125° C. and a solvent dosage within a range of 50 to 450 percent;

wherein said hydrocarbon feedstock has a boiling range in a range of 300-550° C.; and wherein the refined feedstock consists of paraffinic vacuum gas oil that does not contain aromatics or naphthenes.

* * * * *